US006238250B1

(12) United States Patent
Stohr et al.

(10) Patent No.: US 6,238,250 B1
(45) Date of Patent: May 29, 2001

(54) IN-JACK SHUNT CONNECTIONS AND METHODS THEREFOR

(75) Inventors: Kristen C. Stohr, Ft. Worth; Thomas A. Dellinger, N. Richland Hills, both of TX (US)

(73) Assignee: Siecor Operations, LLC, Hickory, NC (US)

( * ) Notice: Subject to any disclaimer, the term of this patent is extended or adjusted under 35 U.S.C. 154(b) by 0 days.

(21) Appl. No.: 09/474,205

(22) Filed: Dec. 29, 1999

(51) Int. Cl.[7] ..... H01R 24/00
(52) U.S. Cl. ..... 439/676; 439/188; 379/399
(58) Field of Search ..... 379/399, 430, 379/412, 445; 439/188, 676, 399, 513, 507, 668, 669

(56) References Cited

U.S. PATENT DOCUMENTS

| | | | | |
|---|---|---|---|---|
| 2,802,083 | * | 8/1957 | Lapeyre | 200/298 |
| 4,699,443 | * | 10/1987 | Goodrich et al. | 439/188 |
| 5,017,154 | * | 5/1991 | Matsuoka | 439/492 |
| 5,037,320 | * | 8/1991 | Stolte | 439/188 |
| 5,111,497 | | 5/1992 | Bliven et al. . | |
| 5,313,519 | | 5/1994 | Mickelson et al. . | |
| 5,333,193 | | 7/1994 | Cote et al. . | |
| 5,359,654 | * | 10/1994 | Jensen et al. | 379/397 |
| 5,416,837 | | 5/1995 | Cote et al. . | |
| 5,479,505 | | 12/1995 | Butler et al. . | |
| 5,497,416 | | 3/1996 | Butler et al. . | |
| 5,888,079 | * | 3/1999 | Norden | 439/142 |
| 5,964,614 | | 10/1999 | Daoud . | |
| 6,074,239 | * | 6/2000 | Camps | 439/409 |

* cited by examiner

*Primary Examiner*—Lincoln Donovan
*Assistant Examiner*—Son V. Nguyen

(57) ABSTRACT

Devices and methods by which an effective shunt-type electrical connection between the telephone company lines and subscriber wiring can be established and maintained within a line module. Line modules are described having a jack assemblies with improved arrangements for establishing connections between telco and bridging contacts. In one construction, two contacts are selectively moveable along a pair of channels to be brought into contact with fixed contacts to form an electrical connection between the telephone company and subscriber wiring. In an alternative construction, the fixed contacts are replaced with a contact plate formed of conductive plating. In other aspects, a plug member can be inserted into the jack receptacle to close the tip and ring contacts to create a shunt connection when the cover of the module is closed onto the base. The plug member can be made entirely from non-conductive material. Additionally, when the cover is closed, the two moveable contacts are maintained a suitable distance from one another, to reduce the possibility of arcing.

24 Claims, 9 Drawing Sheets

IN-JACK SHUNT CONNECTIONS AND METHODS THEREFOR

BACKGROUND

The present invention is directed to telephone network interface devices of the type used to provide demarcation between a telephone company's lines and a telephone subscriber's wiring.

Network interfaces provide an interconnection between external telephone company lines and a subscriber's internal wiring. Line modules are the assemblies that are typically used to provide this interface. These devices are useful to provide a demarcation between the telephone company lines and the subscriber's wiring so that responsibility for faults or malfunctions in the system can be segregated. In practice, a number of the line modules are usually housed in a side-by-side relation within a network interface box. Examples of conventional line modules and network interface box assemblies are described in, for example, U.S. Pat. Nos. 5,497,416; 5,479,505; 5,416,837; and 5,313,519.

The line modules generally include a base structure with a hinged cover. The base structure houses a device known as a jacktop that secures the telephone company's incoming lines within the base structure. A telephone jack receptacle is also disposed with the base portion to accept a complimentary RJ-11 style telephone plug. When the plug is inserted within the jack receptacle, an electrical connection is established.

One disadvantage of the RJ-11 style plug and jack is that, during normal operation, the electrical contacts of the plug are very close together, and this can permit arcing from one contact to another. In addition, RJ-11 arrangements are prone to insulation resistance problems that show up as noise on the phone line. In addition, the RJ-11 style plug and jack were designed primarily for indoor use. These devices are not robust enough for long-term outdoor use.

SUMMARY OF THE INVENTION

The present invention provides devices and methods by which an effective electrical connection between the telephone company lines and subscriber wiring can be established and maintained within a line module. Exemplary line modules are described having novel jack assemblies that contain a pair of tip contacts and a pair of ring contacts. In some described embodiments, two of the contacts are generally fixed while the other two are selectively moveable along a pair of channels within the jacktop. The movable contacts are to be brought into contact with the fixed contacts, thereby forming an electrical connection between the telephone company's line and the subscriber's wiring.

In other described embodiments, the fixed contacts are replaced by a contact plate that is preferably formed of a conductive plating on a surface of the jacktop. A conductor extends between the contact plate and screw-type connectors within another portion of the line module.

Other aspects of the present invention comprises a plug member that can be inserted into the jack receptacle to close the tip and ring contacts to create a shunt connection. The plug member is inserted into the jack receptacle when the cover of the module is closed onto the base. Since no electrical connection is established through the plug member itself, the plug can be made entirely from non-conductive material, thereby making this component virtually invulnerable to damage from weather or other hazards.

Additionally, when the cover is closed, the two moveable contacts are maintained a suitable distance from one another to reduce the possibility of arcing between the electrical connections formed by the contacts.

DETAILED DESCRIPTION OF THE INVENTION

Figure 1:
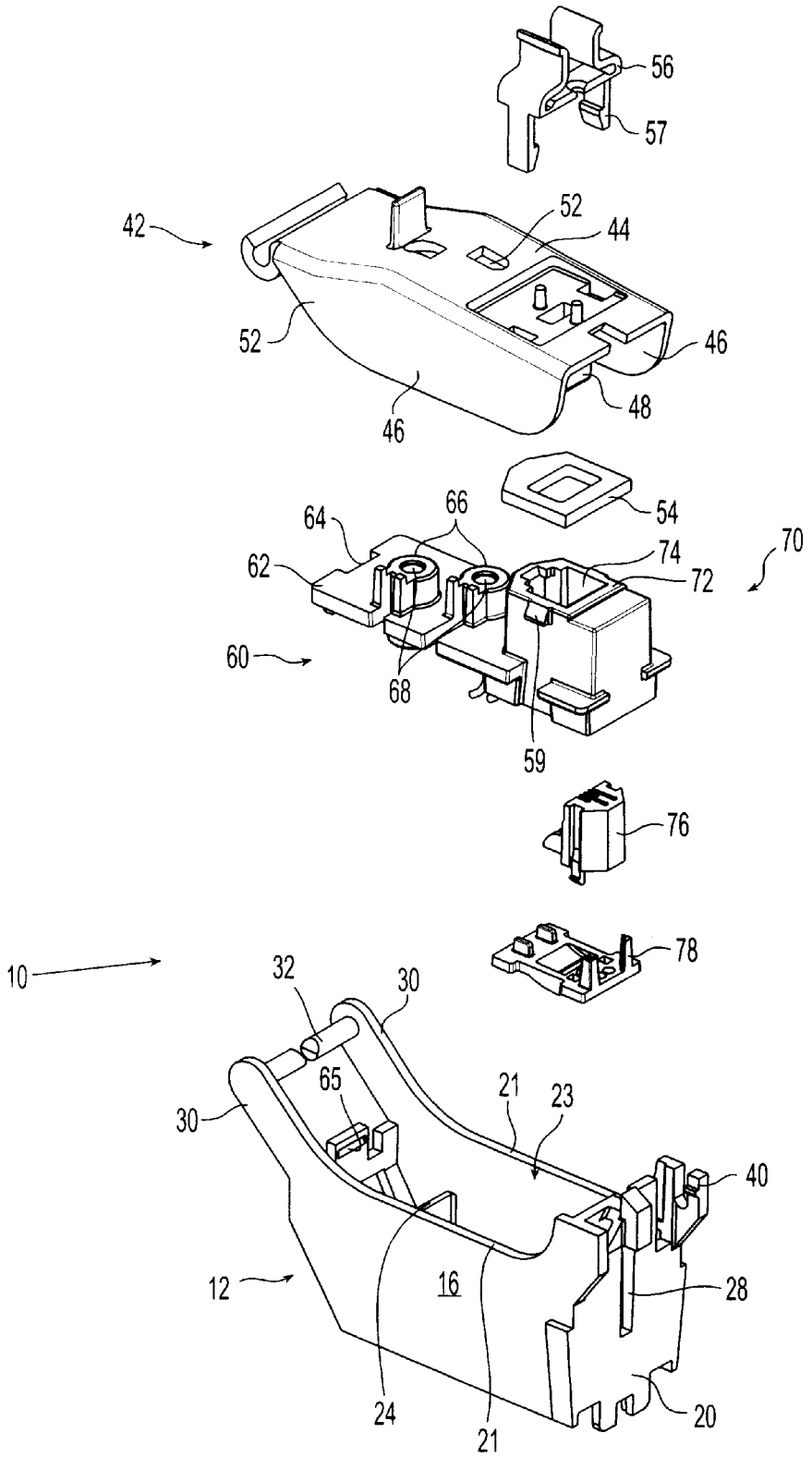
FIG. 1 is an exploded isometric view of an exemplary line module constructed in accordance with the present invention.
Figure 2:
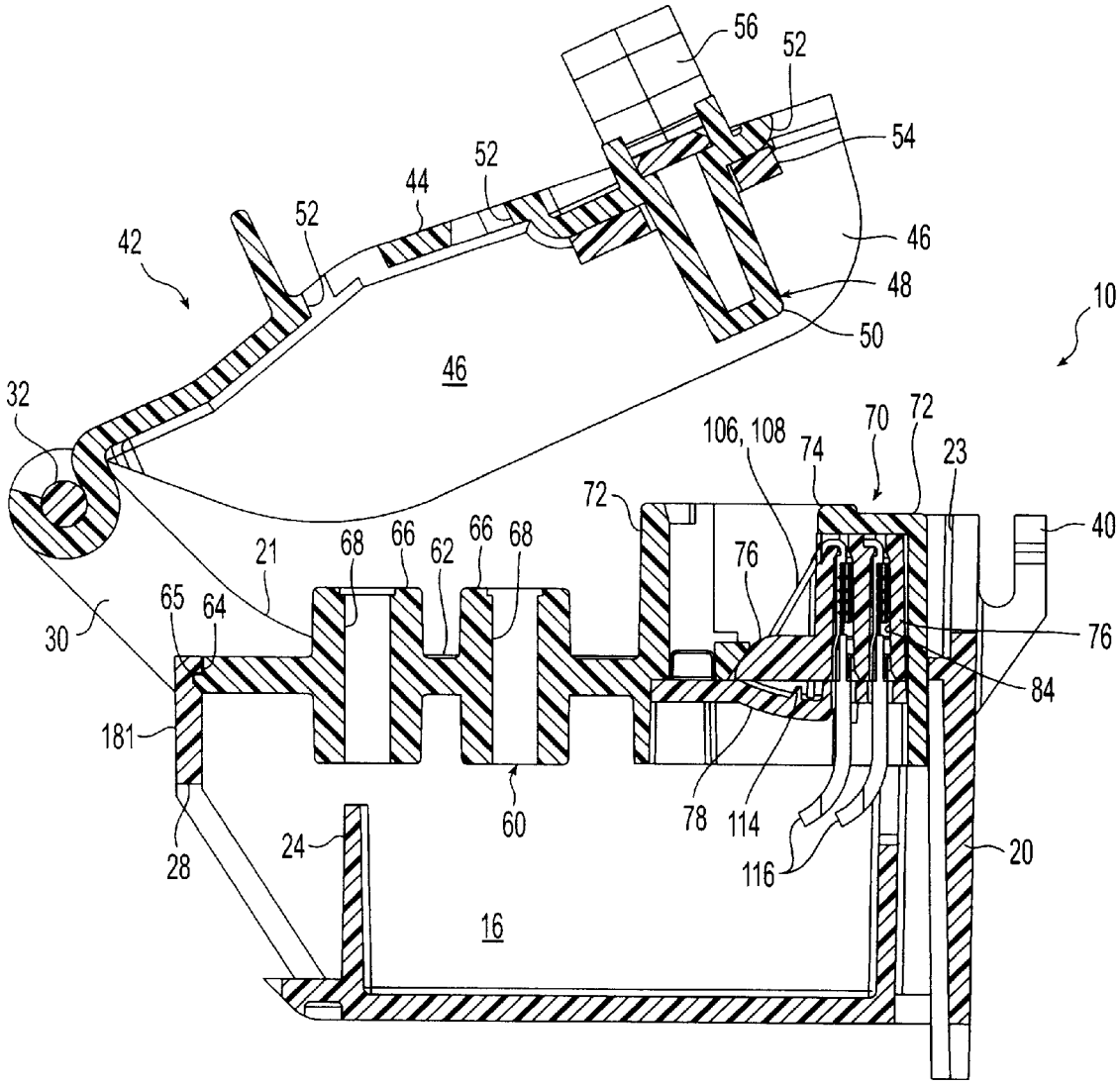
FIG. 2 is a side cross-sectional view of the exemplary line module of FIG. 1 with the cover of the module in an open position.

FIGS. 1–5 depict an exemplary line module 10 that is constructed in accordance with the present invention. The module 10 is typically formed of a durable thermoplastic, while any suitable plastic or resin may be used. The module 10 has a base 12 that is a housing formed of a bottom 14, two side walls 16 (one shown), and first and second end walls 18, 20, respectively. The walls 16, 18, 20 and bottom 14 collectively define an enclosure 22 having an upper opening 23. The side walls 16 have curved upper edges 21.

A pair of vertically-oriented flanges 24 are formed within the enclosure 22. The base 12 also has a number of apertures 28 formed into it through which wires and other small components may be disposed. Proximate the first end wall 18, the side walls 16 present a pair of upwardly extending arms 30 (one shown) that contain a pivot joint 32.

It is noted that the exterior surface of the base 12 can include a number of projections, ledges, catches or other features, such as bracket 40, to assist in securing the base within a network interface box (not shown).

A cover 42 is pivotally secured to the arms 30 of the base 12 via the pivot joint 32 so that the cover 42 may be closed over the opening 23 of the base 12. Cover 42 is also fashioned of a durable plastic or resin. The cover 42 provides a platform 44 having a pair of downwardly depending side walls 46 on either lateral side. It is noted that the side walls 46 are shaped to interfit with the upper edges 21 of the sidewalls of the base 12 in a generally complimentary fashion when the cover 42 is closed onto the base 12.

The platform 44 of the cover 42 retains a downwardly projecting plug member 48 that is substantially rectangular in cross-section. The plug member 48 is preferably fashioned of non-conductive material, meaning that there are no electrically conductive elements disposed within the plug member 48. Suitable non-conductive materials include plastic or resin, and may be integrally formed with the cover 42. The forward, lower engagement portion 50 of the plug member 48 is rounded or chamfered to prevent damage to electrical contacts. A plurality of apertures or holes 52 are also disposed through the platform 44 of the cover 42 for testing. A rubber or foam sealing gasket 54 surrounds the upper portion of the plug member 48. A securing clip 56 is disposed on the upper surface of the platform 44 of the cover 42. The clip 56 has a pair of latches 57 that become secured to complimentary components 59 (one shown in FIG. 1) on the base 12 when the cover 42 is closed onto it, thereby helping to secure the cover 42 onto the base 12.

A removable bridge 60 is disposed within the opening 23 of the base 12. The bridge 60 includes a flat, substantially rectangular frame 62 that is shaped and sized to fit within the opening 23. Frame 62 has a locking tab 64 and base 12 has a complimentary indentation 65 that is shaped and sized to receive the tab 64. The bridge 60 is secured within the opening 23 by disposing the tab 64 within the indentation 65.

Also mounted on the frame 62 are a pair of vertically-oriented cylindrical sleeves 66 that have apertures 68 disposed therethrough and serve as terminals for the connection of subscriber wiring using conductive screws (not shown) that are threadedly inserted into the apertures 68. It is pointed out that the sleeves 66 are prefereably slightly laterally offset, in opposing directions, from the center line of the bridge 60 in order to facilitate attachment of electrical leads. The frame 62 of the bridge 60 also retains a jack assembly, shown generally at 70, the particular construction of which will be described in detail shortly.

The jack assembly 70 includes a housing 72 that substantially encloses and defines the upper portion of the jack assembly 70. An opening 74 within the jack assembly housing 72 is shaped and sized to permit entry of either the plug member 48 or a standard RJ-11 plug.

Figure 6:
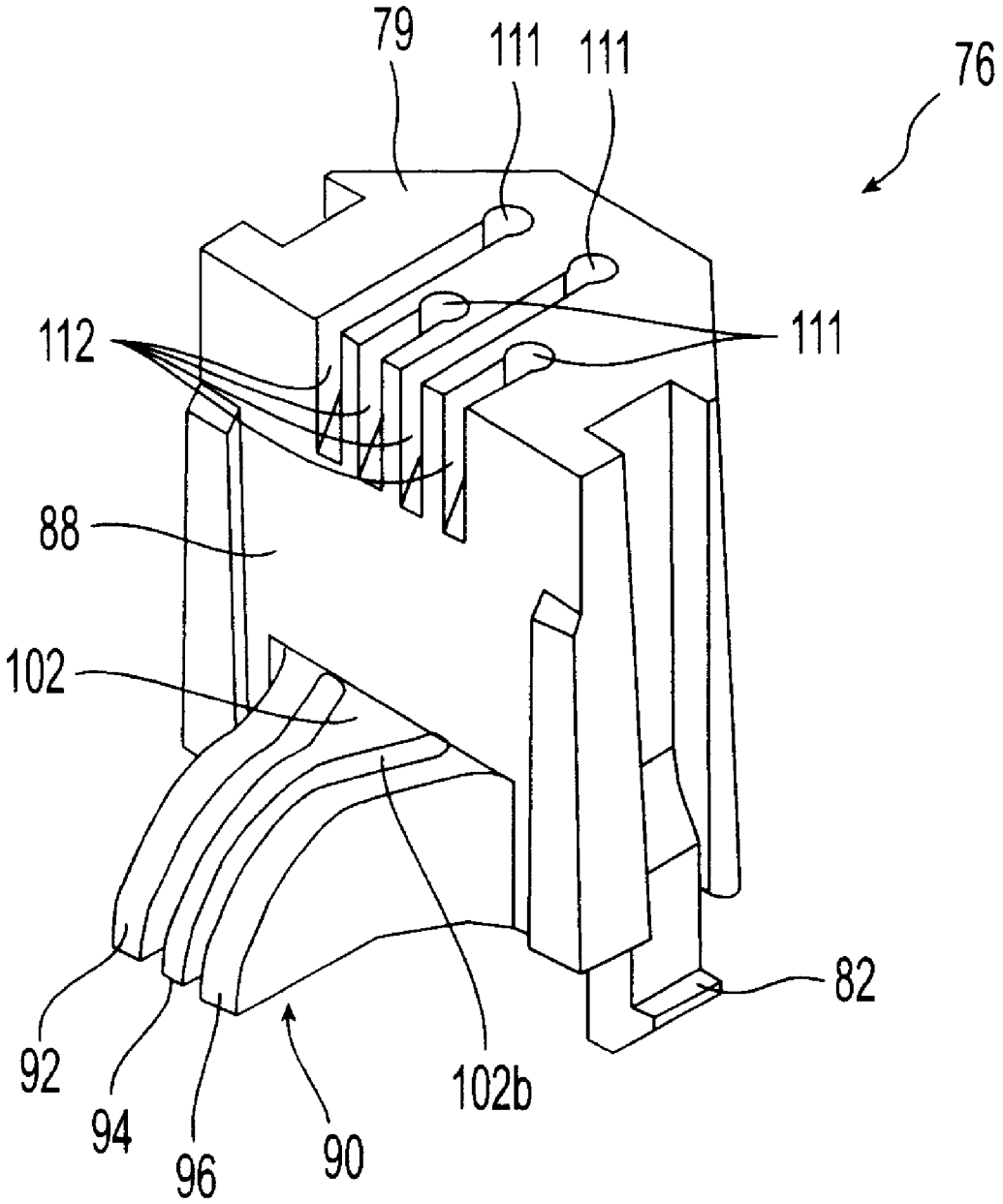
FIG. 6 is an isometric view of an exemplary jacktop assembly in accordance with the present invention.
Figure 7:
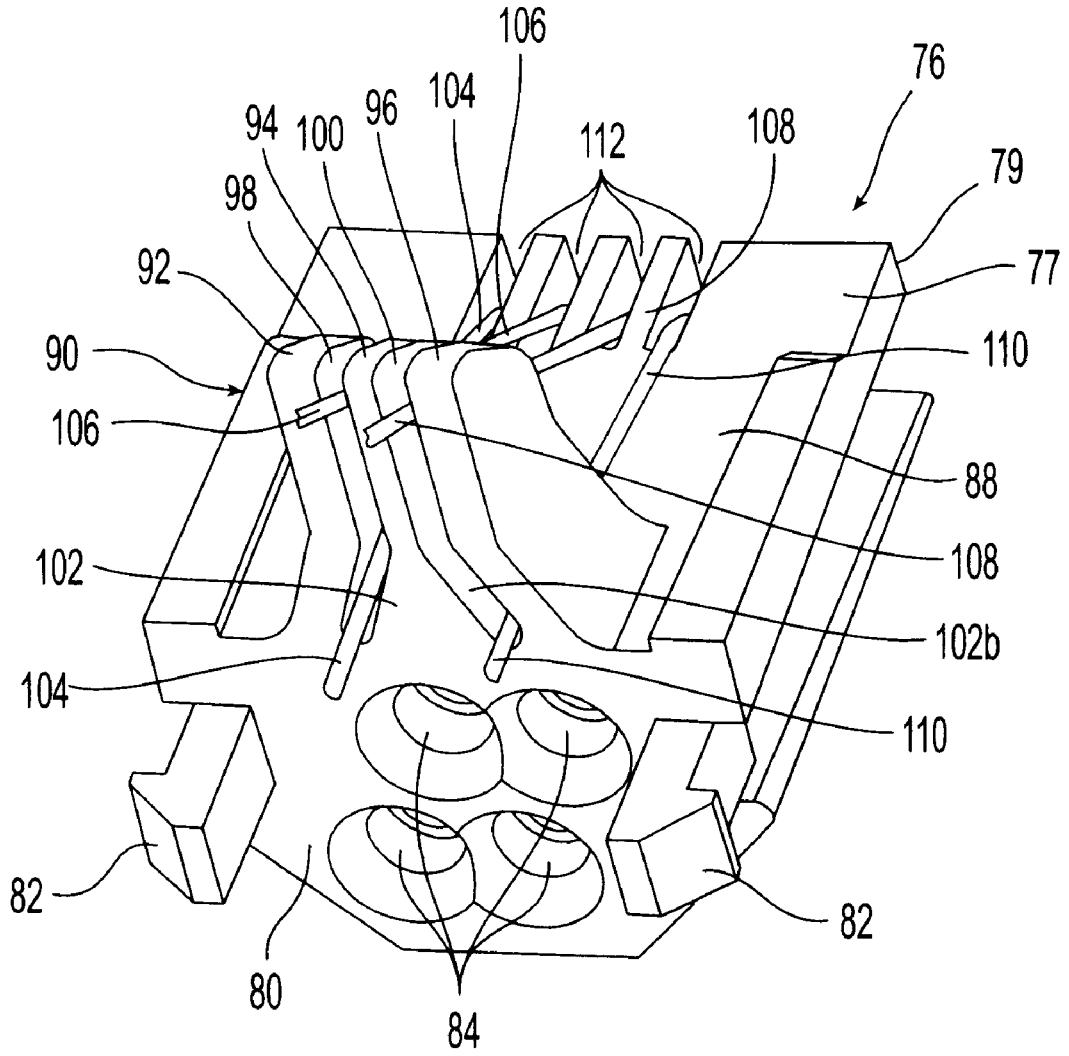
FIG. 7 is a further isometric view of the jacktop assembly of FIG. 6.

A first exemplary jacktop 76 is secured within the housing 72, and barrier 78 is disposed beneath the jacktop 76. Jacktop 76 is shown, apart from the rest of the module 10, in FIGS. 6 and 7. FIG. 6 is a plan view of the jacktop 76 looking downward upon its top surface 79. As shown in FIG. 7, the jacktop 76 has a non-conductive housing 77 that presents a lower surface 80 from which a pair of securing tangs 82 extend for attachment of the jacktop 76 to the barrier 78. Four through-holes 84 are disposed in the lower surface 80 of the jacktop 76 into which telephone company electrical wires are disposed. In barrier 78 are matching apertures 86 that will be aligned with the through-holes 84 when the jacktop 76 and barrier 78 are mated.

The jacktop 76 also presents a front face 88 from which a comb structure 90 projects. The comb structure 90 includes three adjacent combs 92, 94 and 96 that are in a spaced relation to define a pair of guide channels 98, 100 between them. It is noted that the central comb 94 is a blocking structure that separates the two channels 98, 100 and serves to prevent electrical transmission between the two channels 98, 100. The central comb 94 has a base portion 102 that tapers inwardly on either side forming a pair of cam surface 102*a* and 102*b*. The two outer combs 92, 96 are slanted inwardly generally following the tapers so that the guide channels 98, 100 are essentially the same width along their entire lengths and diverge from one another as they approach the front wall 88. In present embodiments, the channels 98, 100 preferably have a width, from comb to comb, of about twenty thousandths of an inch (0.020").

Figure 9:
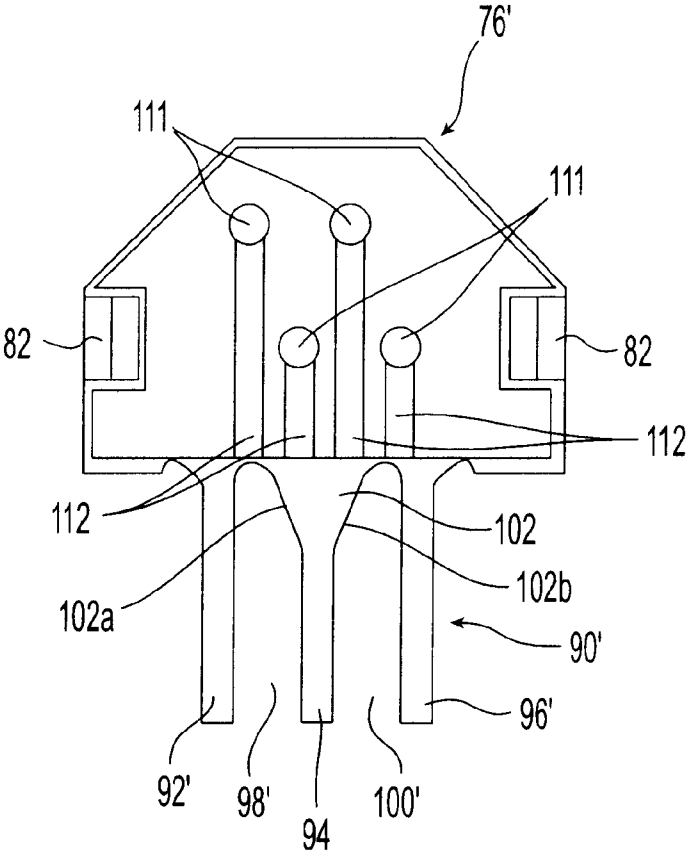
FIG. 9 is a plan view of an alternative jacktop assembly in accordance with the present invention.

FIG. 9 depicts an alternative jacktop structure, designated 76', that can be used in place of the jacktop 76. The jacktop 76' is constructed identically to the jacktop 76 described above with the exception that the outer combs 92', 96' do not slant inwardly to follow the tapers of the base portion 102. Instead, the channels 98', 100' have a generally greater width, from comb to comb, that varies from about 0.042" to 0.020".

As shown in FIG. 7, the jacktop 76 (as well as 76') houses four electrically-conductive contacts 104, 106, 108 and 110. These contacts are substantially rigid wires that extend generally downwardly along the front face 88 from four holes 111 (FIG. 6) through slots 112 to reside within the channels 98, 100. As shown, contact 106 is the ring gold contact. Contact 108 is the tip gold contact. Similarly, contact 104 is the ring bridging contact, and contact 110 is the tip bridging contact. The ring and tip gold contacts 106, 108 are also known as "telco contacts" since they are associated with wiring for a telephone company. The ring and tip bridging contacts 104, 110 are known as subscriber contacts because they are associated with the wiring for a subscriber. Each of the contacts has a width of about eighteen thousandths of an inch (0.018").

As illustrated by FIG. 7, the two leftmost contacts 104, 106 reside within the first channel 98 while the rightmost contacts 108, 110 reside within the other channel 100. The two outermost contacts 104 and 110 are fixed contacts in that they are secured substantially against the front face 88 by engagement at their lower ends with a protrusion 114 from barrier 78 (FIG. 4). However, telco contacts 106, 108 are normally biased outwardly away from front face 88 by the shape memory thereof. Contacts 106, 108 are movable between a first position shown in FIGS. 2, 4 and 7 and a second position shown in FIGS. 3 and 5.

Figure 8:
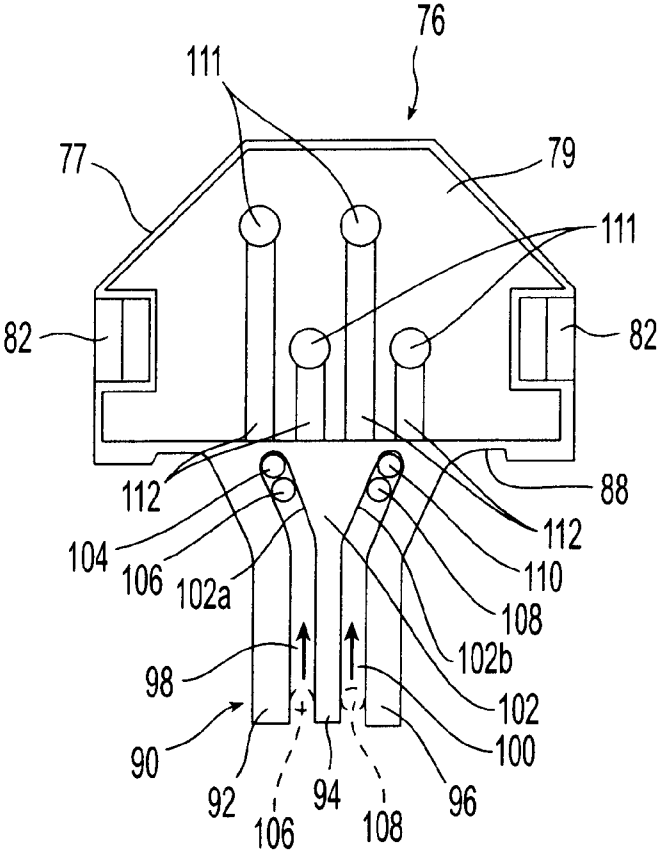
FIG. 8 is a plan view of the jacktop assembly shown in FIGS. 6 and 7, showing the position of the contacts in the closed and open positions.

The first position is the normal, default position for the contacts 106, 108, and in this position, the contacts reside in the outer portions of the channels 98, 100, as shown in FIG. 7 and in dotted lines in FIG. 8. It is noted that the contacts 106, 108 do not touch or engage the fixed contacts 104, 110 in this first position.

When the contacts 106, 108 are moved to their second position (shown in FIG. 5 and in solid lines in FIG. 8), they are urged inwardly along the guide channels 98, 100 and divergently cammed away from one another until they are brought into engagement with the fixed contacts 104, 110, respectively. In this second position, one electrical connection is formed between contacts 106 and 104 within channel 98, and a second electrical connection is formed between contacts 108 and 110 within channel 100.

A suitable distance is maintained between the two moveable contacts 106, 108 by the triangular portion 102 of the comb structure 90 in order to help prevent the possibility of arcing between the electrical connections formed by contacts 106 and 104 in the left channel 98 and the connection formed by contacts 108 and 110 in the right channel 100. A currently preferred distance is approximately 0.100". The configuration of the comb structure 90 of jacktop 76 will cause the moveable contacts 106, 108 to be in closer proximity to one another when they are in their first position owing to the inward slant of the two outer combs 92, 96 (see FIG. 8). The comb structure 90' of the alternative jacktop 76' provides for wider channels 98', 100' that allow the moveable contacts 106, 108 to move more easily therewithin. As a result, the comb structure 90' may be preferable in operation.

Further electrical wiring for the line module 10 will not be described here, as such is relatively standard in line modules that form an interface between telephone company and subscriber wiring. It is noted, however, that electrical wiring components associated with telephone company and subscriber circuitry, generally shown at 116, are potted within the jack assembly 70. Portions of these components are disposed within the through-holes 84 of the jacktop 76 to be operatively associated with the four contacts 104, 106, 108 and 110.

Figure 3:
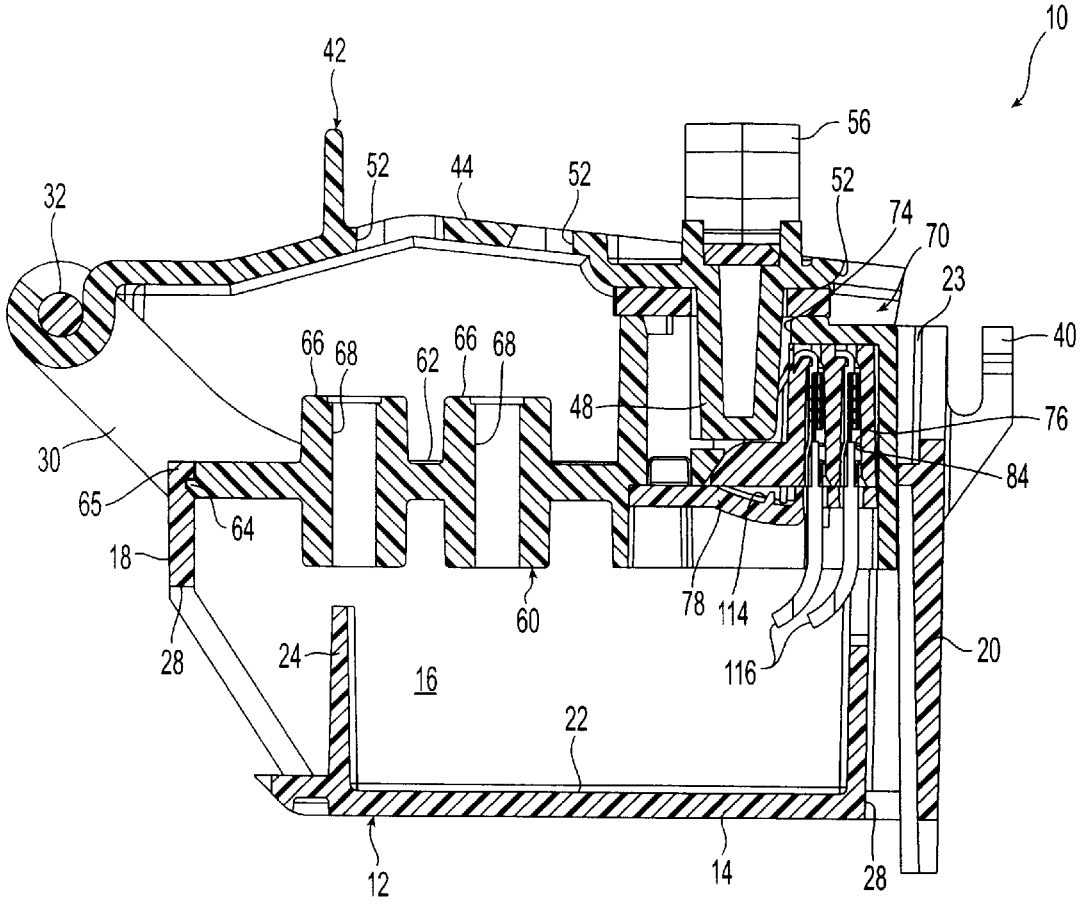
FIG. 3 is a side cross-sectional view of the exemplary line module of FIG. 1 with the cover of the module in a closed position.
Figure 4:
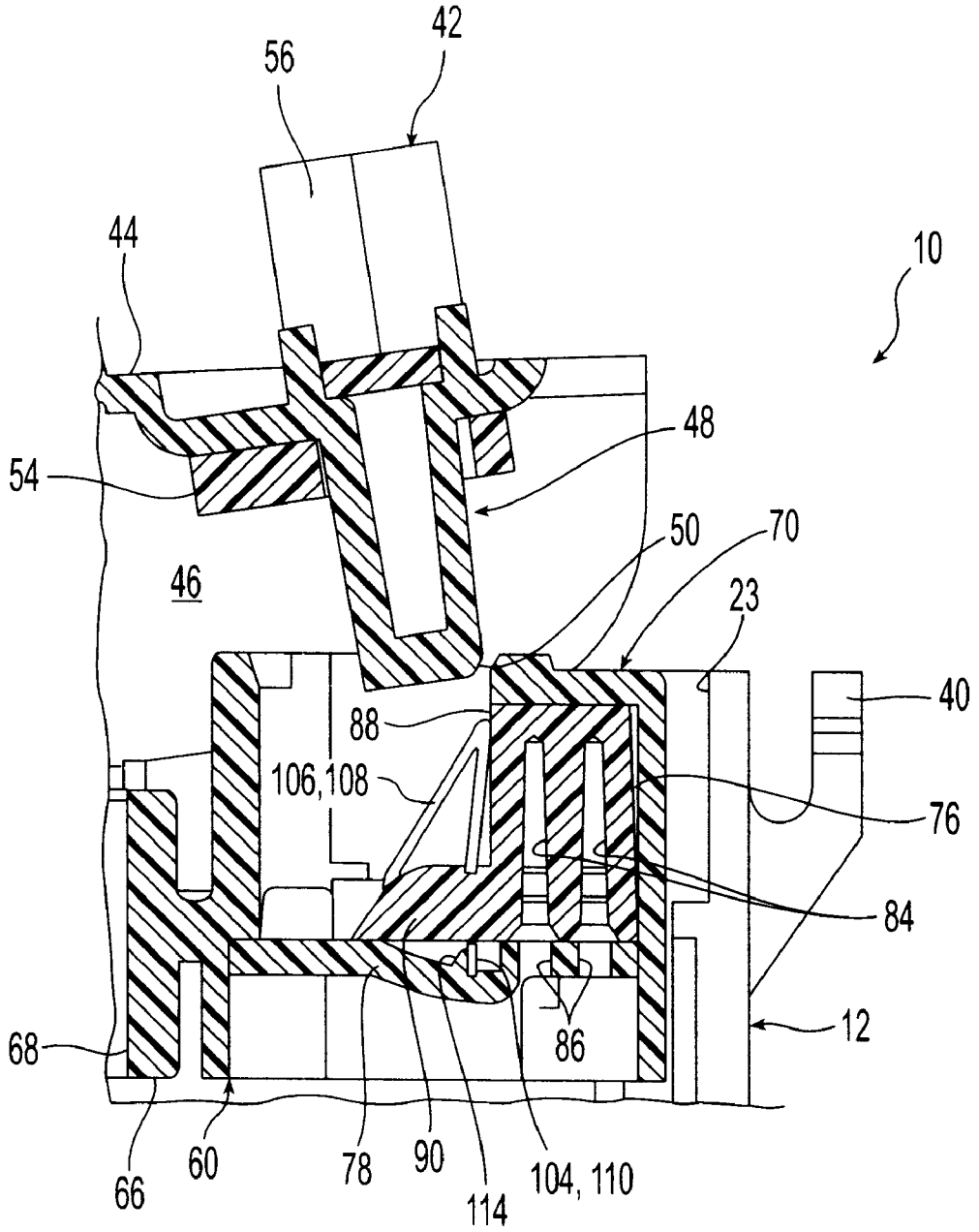
FIG. 4 is a close-up side view of the jacktop assembly portion of the line module with the cover of the module in an open position.
Figure 5:
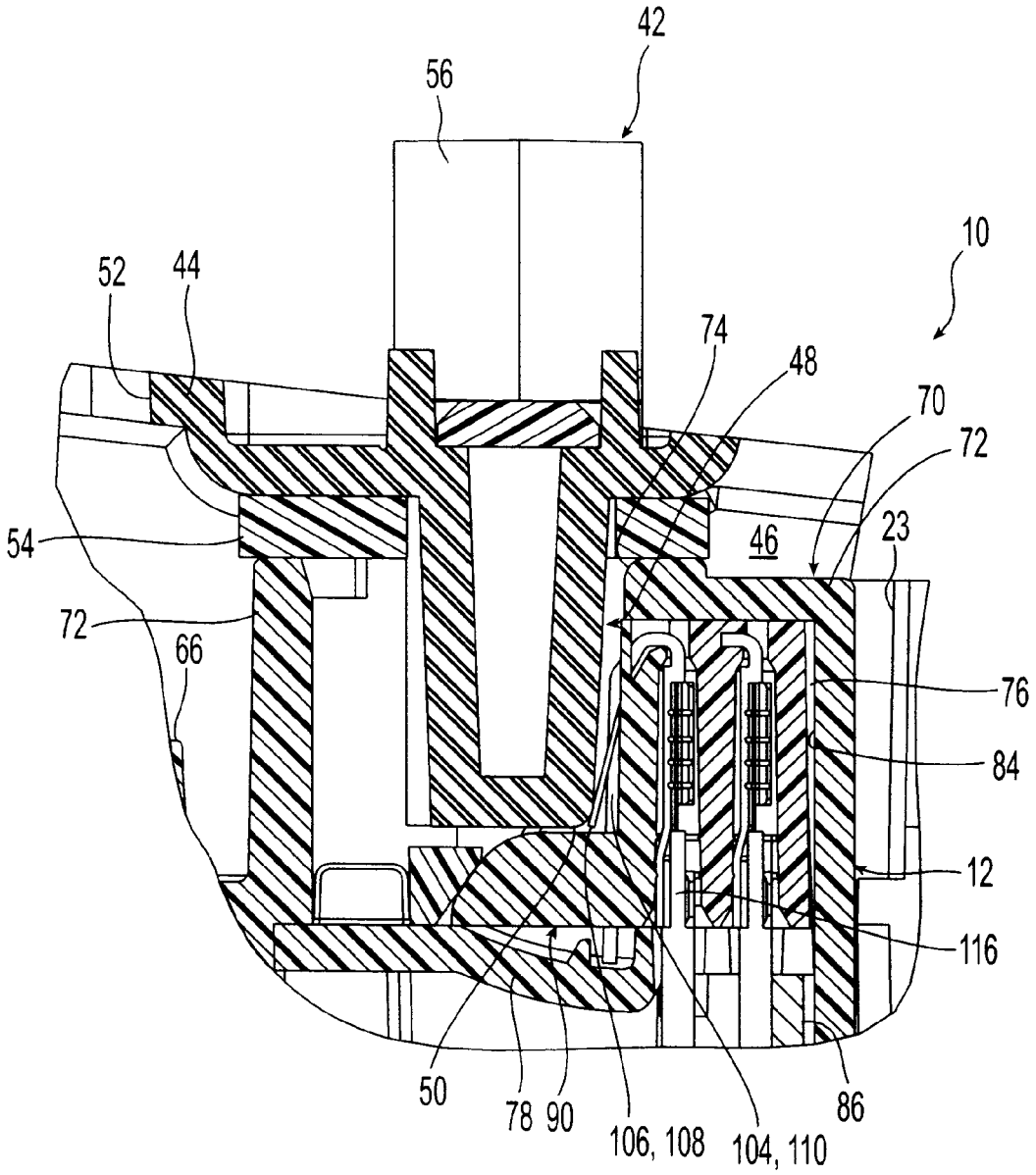
FIG. 5 is a close-up side view of the jacktop assembly portion of the line module with the cover of the module in a closed position.

In operation, the cover 42 of the module 10 is rotated downwardly upon pivot 32 to the closed position on the base 12 shown in FIGS. 3 and 5. When this is done, the plug 48 is disposed into the opening 74 of the jack assembly 70. The engagement portion 50 of the plug 48 engages the moveable contacts 106, 108 and urges them along the channels 98, 100 until they are brought into a shunt-type engagement with the fixed contacts 104, 110. See FIG. 8. When the moveable contacts 106, 108 are placed in engagement with the fixed contacts 104, 110, an electrical shunt connection is established between the moveable and fixed contacts, thereby creating an interface between the telephone company wiring and subscriber wiring. Conversely, when the cover 42 is moved back to the open position, shown in FIGS. 2 and 4, the moveable contacts 106, 108 are permitted to return to their first positions, thereby breaking the electrical connection that had been established.

It is also pointed out that the opening 74 of the jack assembly 70 will receive a standard RJ-11 test plug (not shown) of a type known in the art for testing the integrity of the telephone network. When a test jack is inserted into the opening 74, the moveable contacts 106, 108 will engage complimentary contact members upon the test plug thereby establishing an electrical connection between the jack assembly 70 and the test plug.

Figure 10:
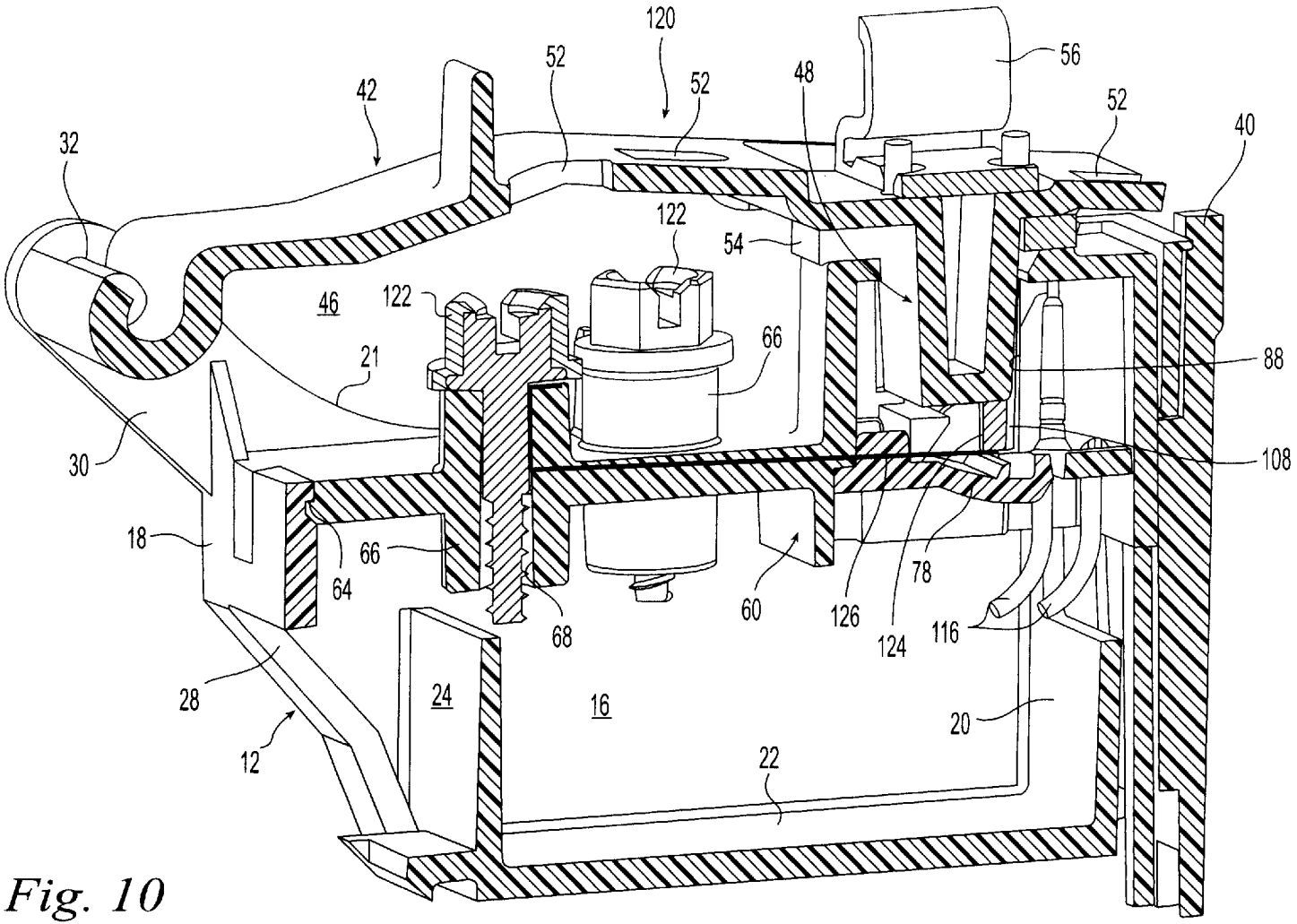
FIG. 10 is a partial cutaway view illustrating an alternative embodiment of the present invention wherein the bridging contacts are formed of conductive plating.

Turning now to FIG. 10, an alternative line module 120 is depicted in cross-sectional cutaway to illustrate an alternative aspect of the present invention. Screw-type terminals 122 are shown disposed in the apertures 68 of the sleeves 66. The alternative line module 120 is constructed identically to the line module 10 described earlier in all respects other than those identified hereinafter. Therefore, for clarity, like components are numbered alike.

In this embodiment, the ring and tip bridging contacts 104, 110 described earlier have been eliminated and replaced by a contact plate 124 (indicated with shading) that is formed of a conductive plating disposed onto the lower half of the front face 88 of the jacktop 76. The conductive plating is preferably gold, but other conductive metals or materials could also be used.

A conductive path is provided through portions of the bridge 60 extending between the contact plate 124 and the screw-type terminals 122. An exemplary conductive path 126 is shown in FIG. 10 that extends from the contact plate 124 to one of the screw-type terminals 122. The conductive path 126 may be made up of a number of conductive elements including one or more wires or filaments that are capable of conducting electricity. Alternatively, the conductive path 126 may be made up of additional conductive plating on portions of the bridge 60.

The telco contacts 106, 108 are, as described previously, normally spring biased away from the contact plate 124. When the cover 42 is closed onto the base 12, the telco contacts 106, 108 are urged inwardly and downwardly to engage the contact plate 124 thereby completing electrical connections between the telco contacts 106, 108 and the terminals 122 that are associated with subscriber wiring. In FIG. 10 the tip gold telco contact 108 is visible and shown being biased for engagement against the contact plate 124 by the plug 48 of the cover 42.

The use of a contact plate 124 as a part of the conductive pathway 126 has operational advantages. The requirement to maintain a certain distance between telco and bridging contacts is eliminated. The barrier 78 may even be eliminated since there is no need to restrain the bridging contacts in a downward position to maintain them away from the telco contacts.

While the invention has been shown or described in only some of its forms, it should be apparent to those skilled in the art that it is not so limited, but is susceptible to various changes within departing from the scope of the invention.

What is claimed is:

1. A line module for providing an electrical interface, comprising:

a base having a jack assembly positioned therein, the jack assembly comprising a housing having an opening therewithin and a fixed electrical contact disposed within the opening of the housing; and a movable electrical contact disposed within the opening of the housing that is selectively movable between a first position wherein the movable contact does not engage the fixed contact and a second position wherein the movable contact engages the fixed contact to establish an electrical connection;

wherein the housing further comprises a channel within which the fixed contact and the moveable contact are disposed, the movable contact being moveable within the channel to engage the fixed contact.

2. The line module of claim 1 further comprising a plug that is selectively insertable into the jack assembly to move the moveable contact into the second position upon insertion of the plug.

3. The line module of claim 2 wherein there are no electrically conductive elements disposed within the plug.

4. The line module of claim 2 wherein the plug is secured within a cover hingedly attached to the base unit.

5. The line module of claim 2 wherein the plug has a rounded engagement portion for engagement of the moveable contact.

6. The line module of claim 1 wherein the fixed contact comprises conductive plating disposed upon a portion of the jack assembly.

7. A line module for providing an electrical interface, comprising:

a base having a jack assembly positioned therein, the jack assembly comprising a housing having an opening therewithin and a pair of fixed electrical contacts disposed within the opening of the housing; and a pair of movable electrical contacts disposed within the opening of the housing that are selectively movable between a first position wherein the movable contacts do not engage the fixed contacts and a second position wherein the movable contacts engage the fixed contacts to establish a pair of electrical connections;

wherein the housing further comprises a pair of channels within each of which one of the fixed contacts and one of the moveable contacts are disposed, the movable contacts being moveable within the channels to engage the fixed contacts.

8. The line module of claim 7 wherein the jack assembly further comprises a comb structure that defines the channels.

9. The line module of claim 8 wherein the comb structure further defines a blocking member disposed between the channels.

10. The line module of claim 9 wherein the blocking member further comprises a generally triangular-shaped portion that cams the moveable contacts apart from one another.

11. The line module of claim 8 wherein the channels are the same width along the entire length of the channels.

12. The line module of claim 11 wherein the width of the channels is 0.02".

13. The line module of claim 8 wherein the channels have a width varying from 0.042" to 0.020".

14. A shunt arrangement for establishing an electrical connection between electrical contacts, the arrangement comprising:

a jack receptacle having an opening therewithin, a pair of bridge contacts disposed within the opening and ring and tip electrical contacts disposed within the opening, each of the ring and tip contacts being selectively movable into contact with a respective one of the bridge contacts to establish an electrical connection therebetween; and a plug shaped and sized to be inserted within the jack receptacle to cause the ring and tip contacts to be brought into contact with the bridge contacts;

wherein the jack receptacle further comprises a pair of channels within each of which one of the ring and tip contacts and one of the bridge contacts are disposed, the ring and tip contacts being moveable within the channels to engage the bridge contacts.

15. The shunt arrangement of claim 14 wherein the pair of channels comprises first and second guide channels to guide movement of the ring and tip contacts toward the bridge contacts as the plug is inserted within the jack receptacle.

16. The shunt arrangement of claim 15 wherein the first guide channel diverges from the second guide channel.

17. The shunt arrangement of claim 15 wherein the guide channels are defined by a plurality of combs.

18. The shunt arrangement of claim 14 wherein there are no electrically conductive elements disposed within the plug.

19. A jacktop for use within a telephone equipment line module comprising:

a non-conductive housing having a front face;

a comb structure that projects from the front face and defines a guide channel;

a fixed contact disposed within the guide channel; and a moveable contact disposed within the guide channel and selectively moved along the guide channel to be brought into engagement with the fixed contact.

20. The jacktop of claim 19 wherein there is more than one guide channel, fixed contact, and moveable contact.

21. A line module for providing an electrical interface, comprising:

a base having a jack assembly positioned therein, the jack assembly comprising a housing having an opening therewithin and an electrically conductive contact plate disposed within the opening of the housing; and a movable electrical contact that is selectively movable between a first position wherein the movable contact does not engage the contact plate and a second position wherein the movable contact engages the contact plate to establish an electrical connection;

wherein the housing further comprises a channel within which the contact plate and the moveable contact are disposed, the moveable contact being moveable within the channel to engage the contact plate.

22. The line module of claim 21 further comprising a conductive path extending from the contact plate to an electrical terminal.

23. The line module of claim 21 further comprising a plug that is selectively insertable into the opening of the housing to move the movable contact into the second position upon insertion of the plug and wherein there are no electrically conductive elements disposed within the plug.

24. A method for establishing an electrical connection between a fixed electrical contact and a movable electrical contact in a line module comprising the steps of:

providing a base having a jack assembly comprising a housing having an opening therein, the fixed electrical contact and the movable electrical contact disposed within the opening of the housing, the housing further comprises a channel within which the fixed contact and the moveable contact are disposed, the movable contact being moveable within the channel to engage the fixed contact;

providing a plug configured to be inserted within the opening of the housing; and inserting the plug into the opening of the housing, the plug causing the movable electrical contact to move from a first position wherein the movable contact does not engage the fixed contact to a second position wherein the movable contact engages the fixed contact to establish the electrical connection.

* * * * *